United States Patent [19]

Bertiller et al.

[11] Patent Number: 4,642,928

[45] Date of Patent: Feb. 17, 1987

[54] INSERT FOR REDUCING THE CALIBER OF A WEAPON

[75] Inventors: Roland Bertiller; Gerd Kellner, both of Schramberg; Helmut Reudelsterz, Oberndorf, all of Fed. Rep. of Germany

[73] Assignee: Mauser-Werke Oberndorf GmbH, Fed. Rep. of Germany

[21] Appl. No.: 620,892

[22] Filed: Jun. 15, 1984

[30] Foreign Application Priority Data

Jun. 25, 1983 [DE] Fed. Rep. of Germany ..... 3322979

[51] Int. Cl.[4] ..... F41C 21/10; F41F 17/06

[52] U.S. Cl. ..... 42/77; 89/29

[58] Field of Search ..... 42/77; 89/29

[56] References Cited

U.S. PATENT DOCUMENTS

| | | | |
|---|---|---|---|
| 213,616 | 3/1879 | Bowles | 42/77 |
| 3,805,434 | 4/1974 | Sudano | 42/77 |
| 4,404,765 | 9/1983 | Reudelsterz et al. | 42/77 |

FOREIGN PATENT DOCUMENTS

| | | | |
|---|---|---|---|
| 2518976 | 11/1976 | Fed. Rep. of Germany | 42/77 |
| 3048620 | 7/1982 | Fed. Rep. of Germany . | |
| 331994 | 7/1930 | United Kingdom . | |
| 356839 | 9/1931 | United Kingdom . | |

*Primary Examiner*—Deborah L. Kyle
*Assistant Examiner*—Ted L. Parr
*Attorney, Agent, or Firm*—McGlew and Tuttle

[57] ABSTRACT

An insert for a weapon barrel for facilitating the firing of a small caliber ammunition comprises a tubular member having a bore defining a distinct caliber with one end having an exterior surface ending in a raised shoulder forming an abutment for a compensating bushing positioned on the exterior surface and abutting the shoulder. A sleeve is positioned on the exterior surface alongside and abutting against the bushing. This end of the insert carries a first locking mechanism for locking the sleeve radially in the barrel. This includes a tapered spreader sleeve which engages with a tapered exterior surface of the sleeve positioned on the insert adjacent the compensating bushing. The spreader sleeve is urged into bearing engagement with the tapered surface of the other sleeve by means of a knot threaded over the insert and advanced toward the spreader sleeve. A safety key is insertable through an opening in the sleeve and it engages in a longitudinal slot formed on the insert. The opposite end of the insert includes a collet which bears against a raised annular portion of the insert which forms a stop. The collet carries a plurality of damping elements over which a thrust collar having a taper is positioned and the clamping elements are urged by one or more clamping screws to engage this end tightly against the conical portion of the cartridge chamber of the weapon barrel. A spreader sleeve at this end is advantageously threaded over a collar formation of the collet at its outer end, and the collet itself is advantageously threadably engaged on the insert.

10 Claims, 4 Drawing Figures

INSERT FOR REDUCING THE CALIBER OF A WEAPON

FIELD AND BACKGROUND OF THE INVENTION

This invention relates in general to weapon construction and in particular to a new and useful device for adjusting the caliber of a weapon so that it will fire a smaller caliber ammunition.

The invention relates to a device to fix and lock the radial and axial position of a tubular insert in the barrel of a weapon whose caliber is bigger than that of the ammunition to be fired.

The German Design Pat. No. 68 009 469 discloses a device for shooting cartridged ammunition out of the barrel of a weapon whose caliber is bigger than that of the ammunition to be fired. Disposed in the barrel is a tubular insert which is fixed axially and radially and has a coneshaped tube bottom resting against the conical countersurface of the cartridge chamber.

Known from German OS 30 48 620 is a practice firing device for cannons and guns which has a barrel with a smaller caliber tube retained in it by means of centering discs. An adjusting ring in the area of the middle centering disc serves the axial insert system in the barrel.

The insert system is affected by a great variety of stresses which must, however, not lead to an impairment of its function and safety. For instance, longitudinal expansions must be taken into account to which the tubular insert and the barrel are exposed due to thermal stresses caused by the firing action and due to environmental influences, and the shot pulses and shocks when traveling off the road must be considered as well.

SUMMARY OF THE INVENTION

The invention provides a mechanism to fix and lock a tubular insert in a barrel in its position radially and axially, whereby the tubular insert and the barrel are movable relative to each other in axial directions, but there is no shifting in their coaxiality on the other. The invention also provides a construction to lock the tubular insert to a fixed dimension relative to the barrel in axial directions so that the transition of the adaptation cartridge with the cartridge chamber to the tubular insert does not change.

According to the invention, the tubular insert has at its front end an annular shoulder, against which rest a compensation bushing which slides on from the front, and a sleeve which adjoins the compensation bushing axially and can be locked radially to a spreader sleeve in the barrel by means of an outside taper. A collet is screwed to the bottom of the tubular insert against an annular stop of the insert, there being inserted in the collar of this collet, on a pitch circle, clamping screws which act upon one or more annular clamping elements concentrically disposed on the collet shaft. A spreader sleeve can be screwed to the outside diameter of the collar, and the outside taper of the spreader sleeve interacting with the cartridge chamber taper of the barrel. The tubular insert is fixed coaxially in the larger caliber barrel by the front tube clamping element, and both tubes are kept movable relative to each other in axial directions. The tubular insert of smaller caliber is fixed and locked in the barrel by the bottom tube clamping element, thereby preventing that the tubes lose their mutual concentricity. The bottom tube clamping elements can be installed universally in various barrels.

For this purpose it is only the collet with the appropriate cartridge taper which must be exchanged.

To secure the sleeve against rotation on the tubular insert, the sleeve has a radial hole in a further development of the invention, in which a safety bolt is inserted through the outer spreader sleeve to project into the longitudinal slot in the tubular insert provided below the hole.

Furthermore, a threaded nut is screwable axially to the front end of the tubular insert against the spreader sleeve and is secured by a tangentially movable pin with an encircling safety ring. The threaded nut can cause the spreader sleeve to spread over the taper, thereby clamping the sleeve.

The clamping screws of the bottom tube clamping elements act in an advantageous manner via a thrust collar upon the annular clamping element to thereby make possible uniform clamping on a circular ring. The annular clamping elements may be of tapered design, their tapered surfaces resting on top of each other in pairs. Due to this form and configuration of the annular clamping elements they are spread apart radially when the clamping screws exert axial pressure.

In a further development of the invention spacer rings may be inserted between the annular clamping elements installed in pairs with a spacer ring disposed at the end to insure that the annular clamping elements are in contact with the annular stop on the tubular insert. Both the spreader sleeve and the collet may have longitudinal slots evenly distributed over their circumference so that the clamping force emanating from the clamping screws is positively transmitted to the barrel and to the tubular insert.

In a still further development, the annular clamping element is advantageously provided with an internal buttress thread which interacts with the external buttress thread of the collet. With this annular clamping element design the clamping forces remain equal over the entire clamping length.

The collet may have a solid center part and reduced sections at both ends in order to attain the necessary elasticity.

Furthermore, the spreader sleeve may be designed as a hollow part in which are inserted cone shaped clamping segments distributed over the circumference, held together as a unit by a spring ring and resting on a sleeve shaped ring pushed over the annular clamping element.

In the collet end area may also be provided a pin hole in which a locking pin is inserted which projects into a longitudinal slot in the annular clamping element to prevent mutual twisting of the components. In addition, the annular clamping element can be locked and unlocked in axial directions by means of the longitudinal slot. Fixation is necessary for the adjustment to the exact axial dimension of the tubular insert because when the spreader sleeve turns on the collet, the collet could co-rotate, thereby altering the clamping travel.

Accordingly, it is an object of the invention to provide an improved insert for a weapon which comprises a tubular member with means at end for anchoring it in position in the weapon bore.

A further object of the invention is to provide an improved means for an insert to the bore of a weapon.

A further object of the invention is to provide a weapon having an adjustable caliber which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
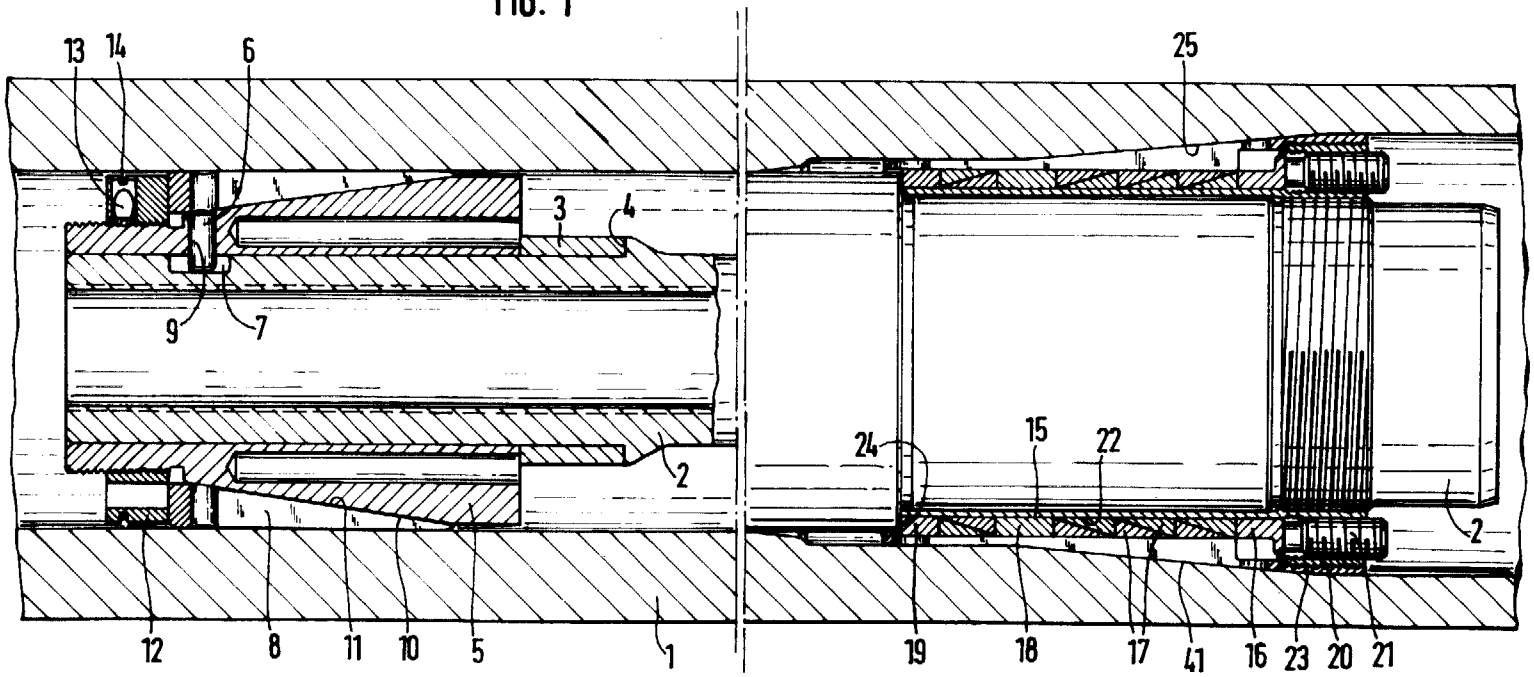
FIG. 1 is an axial sectional view of the head and bottom device to fix and lock the tubular insert in the barrel.

Referring to the drawings in particular the invention embodied therein comprises an insert 2 for a weapon barrel 1 facilitating the firing of a smaller caliber ammunition. The insert 2 comprises a tubular member having a bore defining a smaller caliber than the bore of the barrel 1. The tubular insert 2 has one end near its muzzle with an exterior surface ending in a raised shoulder 4, and a compensating bushing engaged around the insert bears against the shoulder and a locking sleeve positioned on the exterior surface of the insert and bears against the bushing. The arrangement includes first locking means for locking the locking sleeve 5 and thus the insert in the barrel at this end and this includes a first tapered spreader sleeve 8 having a tapered surface 11 which engages against a tapered surface 10 of the sleeve 5. The first locking means also includes clamping means in the form of a clamping nut 12 which is threaded onto the sleeve 5 and bears against an end of the spreader sleeve 8. In addition, the first locking means includes a key 6 which engages in a slot 7, a locking ring 14 and a pin 13. Ring 14 sits in an annular groove around the nut 12.

The insert 2 has a raised annular stop formation 24 spaced axially from an end opposite said one or muzzle end and a tubular collet is engaged over this opposite or breech end and has an inner end which abuts against the stop 24. The opposite end of the collet (near the breech end of insert 2) has a collar 20. Second locking means carried by the collar and the remaining portion of the collet may anchor the collet in the bore adjacent the stop 24 in a position of the cartridge chamber cone 25. The second locking means includes clamping screws 21 in the collet collar 20 and clamping elements 17 and 18 which are engaged around the collet as well as a second spreader sleeve 23 which may be threaded to the collar and has a tapered surface which bears against a conical exterior of the chamber cone 25.

As noted earlier, a device by means of which the tubular insert 2 is fixed coaxially in the larger caliber barrel 1 is provided at the front end of the tubular insert 2. Since the tubular insert 2 and the barrel 1 are subjected to thermal stresses when firing and through environmental influences, causing length expansions, the tubular insert 2 and the barrel 1 must be movable relative to each other in axial directions. Attached to the tubular insert 2 is a compensating bushing 3 which absorbs the thermal expansion of the tubular insert 2. The compensating bushing rests axially against the annular shoulder 4 of the tubular insert 2. In axial contact with the compensating bushing, the sleeve 5 is pushed over the tubular insert 2 and secured against twisting by the safety key 6 and the longitudinal slot 7. The safety key 6 is fitted radially into the hole 9 of the sleeve 5 from the outside through the spreader sleeve 8. Key 6 in slot 7 and hole 9 thus form anti-rotation means between insert 2 and sleeve 5.

The sleeve 5 is mounted on the tubular insert so as to be movable in the axial direction. The tapered surface 11 of the spreader sleeve 8 is pushed over the external taper 10 of sleeve 5. By tightening the threaded nut 12 the spreader sleeve 8 is spread over the taper, thereby producing the locking action of sleeve 5 to the barrel 1. The threaded nut 12 is locked by the tangentially movable locking pin 13 kept in locked position by the locking ring 14. It can only be unlocked with a special assembly tool when tapered bolts of this tool are inserted in the threaded nut 12, thereby pushing the locking pin 13 outwardly. When removing the assembly tool from the threaded nut 12 again, the locking pin 13 drops back in radially, securing the threaded nut against rotation. Pin 13 locks nut 12 against rotation since it is pressed by ring 14 against the threads of the sleeve 5. Pin 13 sits in a tangential slot in nut 12 so these parts are rotationally fixed to each other.

The device on the tube bottom serves the purpose of fixing the smaller caliber tubular insert 2 in the barrel 1 and locking it concentrically so that there can be shifting of the tubes relative to each other due to firing pulses and shocks caused by off the road travel. In addition, the tubular insert 2 must be clamped to a fixed dimension with respect to the barrel 1 so that the transition adaption cartridge with cartridge chamber to the tubular insert 2 will not change, thus assuring functionality and safety.

The device at the tube bottom or breech end is essentially a preassembled unit consisting of the collet 15 to which are mounted a thrust collar 16, the annular clamping elements 17 and the spacer rings 18,19. The annular clamping elements 17 are cone shaped and their tapered surfaces facing each other contact each other in pairs. The inserted spacer rings 18 are located between the second before the last and the last pair of annular clamping elements 17, whereas the spacer ring 19 is mounted behind (toward the muzzle end) the last annular clamping element 17, terminating the subassembly. The head of the collet 15 has a collar 20, into which clamping screws 21 are screwed on a pitch circle. The annular clamping elements surround the collet shaft 22. Furthermore, the collar 20 is provided with an external thread to which a spreader sleeve 23 is screwed. This complete unit is then screwed on axially up to the annular stop 24 of the tubular insert. Since a cartridge chamber cone 25 in the barrel 1 is defined precisely, the axial adjustment dimensions of the tubular insert can be set exactly by turning the spreader sleeve 23 on the collet.

By crosswise tightening the clamping screws 21 with a torque wrench the annular clamping elements 17 are compressed axially by the thrust collar 16. Due to the tapered surfaces on the annular clamping elements 17 the latter are pushed apart radially, and the clamping force is transmitted positively to the barrel and to the tubular insert by the slotted collet and the spreader sleeve. The fixing and locking device can be installed universally in various barrels. All it needs for this purpose is to exchange the spreader sleeve 23 with the appropriate cartridge cone 41. The assembly is the same for all variants.

Figure 2:
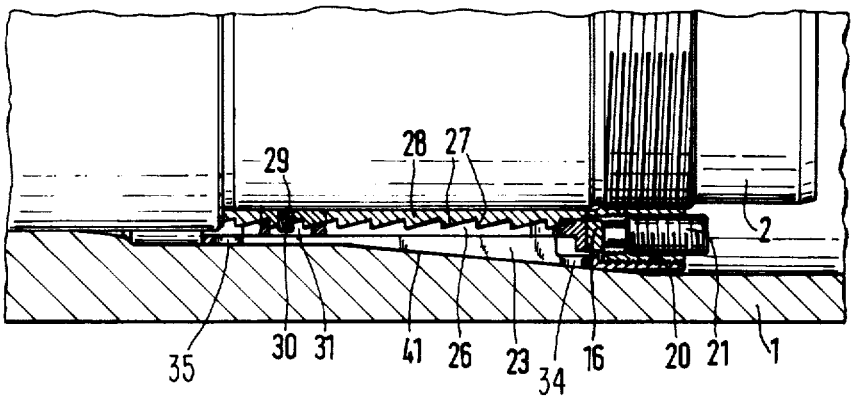
FIG. 2 is a similar view of the bottom device in a different embodiment.
Figure 3:
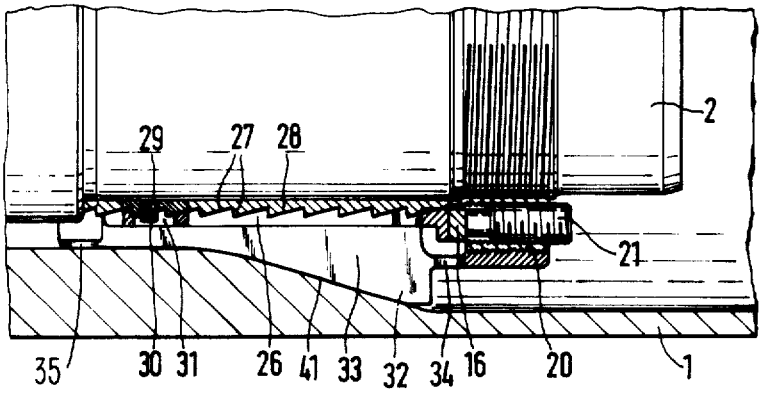
FIG. 3 is a similar view of the bottom device in a modification of FIG. 2, in section.
Figure 4:
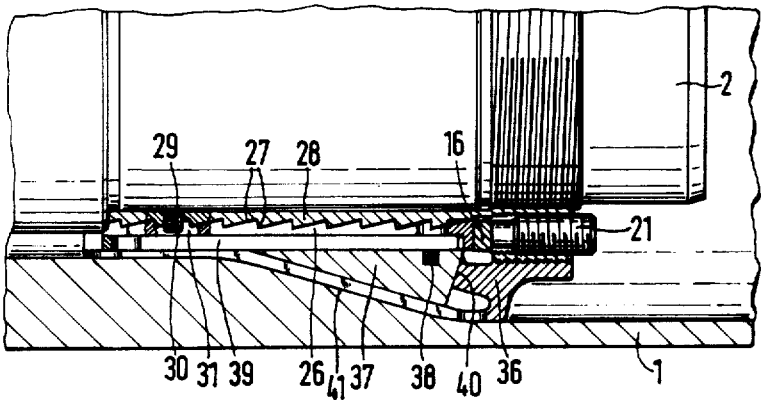
FIG. 4 is a similar view of the bottom device in further modification of FIG. 2, in section.

FIGS. 2, 3 and 4 show other embodiments of the bottom fixing and clamping device for the tubular insert 2.

In FIG. 2, a single sleeveshaped annular clamping element 26 with an internal buttress thread 27 is screwed on the collet 28 which is likewise equipped with a buttress thread. The clamping screws 21 again act upon the annular clamping element 26 via a thrust collar 16. The end of the collet 28 has a radial hole 29 into which a locking key 30 is inserted which projects into the corresponding longitudinal slot 31 of the annular clamping element 26 to prevent mutual twisting or rotation. The annular clamping element 26 can be locked and unlocked in axial directions by the longitudinal slot 31. The fixation is necessary for the exact adjustment of the axial dimension of the tubular insert 2 because when turning the spreader sleeve 23 on the collet 28, the annular clamping element 26 would co-rotate and thereby change the clamping travel.

When installing this version in different caliber barrels, all that needs to be exchanged again is the spreader sleeve 23 with an appropriate cartridge cone. The advantage of the buttress thread is that the clamping forces are the same over the entire clamping length.

The device according to FIG. 3 corresponds in essence to the device of FIG. 2, only the spreader sleeve 32 is designed with a solid center part 33 and thinner sections 34 and 35 at both ends to attain an elasticity in the otherwise rugged component.

The device according to FIG. 4 again builds on the device per FIG. 2. However, it includes several individual elements. The spreader sleeve 36 is designed as a hollow part in which are inserted and distributed over its circumference several clamping elements 37 held together as a unit by a spring ring 38. To keep the clamping elements 37 equispaced, spacer rings are mounted to the spring ring 38. For the transmission of the clamping forces outwardly an intermediate ring 39 is installed between the spreader sleeve 36 or clamping segments 37 and the annular clamping element 26. The intermediate ring 39 may be inserted loosely or else be fixed to the spreader sleeve 36.

When clamping, the clamping segments 37 are pushed radially outward by the intermediate ring 39. The clamping cone 40 controls the clamping segments 37 so that the spreader sleeve 36 is pressed exactly against the cartridge chamber cone. This embodiment of the device also requires only the exchange of the spreader sleeve 36 for other barrel calibers. While specific embodiments of the invention have been shown and described in detail to illustrate the application of the principles of the invention, it will be understood that the invention may be embodied otherwise without departing from such principles.

What is claimed is:

1. An insert for a weapon barrel having a larger caliber, for facilitating the firing of a smaller caliber ammunition through the barrel, the barrel including a cartridge chamber cone portion, comprising a tubular insert having a muzzle end and an opposite breach end, said tubular insert having an annular shoulder near said muzzle end facing toward said muzzle end and an annular stop near said breech end facing said breech end, a compensating bushing engaged around said muzzle end of said tubular insert and engaged axially against said annular shoulder, a locking sleeve engaged on and being radially fixed with respect to said muzzle end of said tubular insert, said locking sleeve having an outer tapered surface and being axially engaged with said compensating bushing for urging said compensating bushing against said annular shoulder, a first spreader sleeve having an inner tapered surface engaged with said outer tapered surface of said locking sleeve, said first spreader sleeve having an outer surface engaged with a bore of the weapon barrel for holding said locking sleeve in a radially fixed position with respect to the weapon barrel, clamping means connected to said locking sleeve and said first spreader sleeve for urging said tapered surfaces toward each other to axially and radially fix said locking sleeve with respect to the weapon barrel, said tubular insert having an external thread on said breech end thereof, a collet threaded onto said external thread of said tubular insert and engaged axially against said annular stop, said collet having a collet shaft which is concentric with the breech end of said tubular insert and a collar connected to said collet shaft and spaced away from said annular stop, said collar having a pitch circle of threaded holes there around, a second spreader sleeve engaged around said collet shaft a plurality of annular clamping elements engaged with each other and concentrically engaged around said collet shaft in between said collet shaft and said second spreader sleeve, and a plurality of clamping screws engaged in said pitch circle of threaded holes, said clamping screws being engaged against at least one of said annular clamping elements for moving said at least one annular clamping element with respect to another annular clamping element for applying radial spreading forces between said collet shaft, and said second spreader sleeve for fixing said breach end of said tubular insert with respect to the weapon barrel, said second spreader sleeve having an outer surface conforming to and engaged against the chamber cone portion of the weapon barrel.

2. An insert according to claim 1, wherein said locking sleeve has a hole therethrough extending radially, a locking key engaged in said hole, said insert having a longitudinal slot into which said locking key engages.

3. An insert according to claim 1, wherein said annular clamping elements are cone shaped and they are arranged in mating pairs so that they have exterior surfaces which lie flush over said collet.

4. An insert according to claim 3, wherein some of said annular clamping elements include annular spacing rings therebetween and including a spacer ring between one of said clamping elements and said annular stop.

5. An insert according to claim 1, wherein said collet and said second spreader sleeve have slots extending in longitudinal directions and evenly distributed over the circumference thereof.

6. An insert according to claim 1, including an annular clamping element around said collet having a buttress thread which interacts with a similar buttress thread on the outside of said collet.

7. An insert according to claim 1, wherein said second spreader sleeve comprises a hollow part and including a plurality of cone shaped clamping segments inserted in said hollow part and including a spring ring holding said segments together as a unit and a sleeve shaped intermediate ring pushed over one annular clamping element on which said clamping segments are resting.

8. An insert according to claim 1, including a pin hole defined at the end of the collet with a locking pin inserted in said pin hole which projects into a longitudinal slot in one annular clamping element.

9. An insert according to claim 1 wherein said clamping means comprises a locking nut threaded tube an end of said locking sleeve spaced from said annular shoulder, said nut being threaded axially against said first spreader sleeve for urging said first spreader sleeve axially against said locking sleeve, said nut having a tangential opening therein, a locking pin in said tangential opening and a locking ring engaged on said nut and urging said locking pin against said locking sleeve.

10. An insert according to claim 1 including a thrust collar engaged between said at least one annular clamping element and said plurality of clamping screws for transmitting axial forces of said clamping screws to said at least one annular clamping element.

* * * * *